United States Patent [19]

Miller

[11] Patent Number: 4,805,786

[45] **Date of Patent: * Feb. 21, 1989**

[54] FINNED TUBE SUPPORT FOR COAT HANGERS

[76] Inventor: Charles R. Miller, 6123 S. Quebec, Tulsa, Okla. 74136

[ * ] Notice: The portion of the term of this patent subsequent to Mar. 25, 2003 has been disclaimed.

[21] Appl. No.: 442,301

[22] Filed: Nov. 17, 1982

[51] Int. Cl.[4] ..... A47H 1/02

[52] U.S. Cl. ..... 211/105.1; 211/123

[58] Field of Search ..... 211/123, 124, 105.1; 206/285, 291, 290, 284

[56] References Cited

U.S. PATENT DOCUMENTS

| | | | |
|---|---|---|---|
| 447,976 | 3/1891 | Rusk | 211/123 |
| 2,526,285 | 10/1950 | Schuyler | 211/123.2 |
| 2,540,023 | 1/1951 | Ackerman | 211/123 X |
| 2,846,079 | 8/1958 | Leeper | 211/123 |
| 2,868,389 | 1/1959 | Friend | 211/123 |
| 4,577,766 | 3/1986 | Miller | 211/113 X |

FOREIGN PATENT DOCUMENTS

| | | | |
|---|---|---|---|
| 369030 | 2/1923 | Fed. Rep. of Germany | 211/105.1 |
| 822313 | 12/1937 | France | 211/123 |

*Primary Examiner*—Ramon S. Britts
*Assistant Examiner*—Sarah A. L. Eley
*Attorney, Agent, or Firm*—William S. Dorman

[57] ABSTRACT

A finned tube support for coat hangers comprising a hollow plastic tube of sufficient length and sufficient internal diameter to slip over a closet rod of the type normally employed for holding hangers thereon in a closet, the plastic tube having a wall thickness of between about 1/32 and 1/16 inch, a plurality of circular plastic disks mounted in spaced parallel relation on the tube and at right angles to the longitudinal central axis of the tube, the disks having an axial thickness of about 1/16 of an inch and a central opening equal to the outer diameter of the tube, the disk having an outer diameter equal to about 2 and ½ inches, the center-to-center spacing from one disk to the next adjacent disk being equal to about ½ inch.

2 Claims, 1 Drawing Sheet

FINNED TUBE SUPPORT FOR COAT HANGERS

BACKGROUND OF THE INVENTION

1. Field of the Invention

The present invention relates to a support for coat hangers. More particularly this invention involves a finned tube support adapted to be slipped over a closet rod for separating adjacent coat hangers.

2. Prior Art

It is conventional practice to store coats, shirts and other garments on hangers in a closet or the like by placing the hook portion of the hanger over a metal or wooden rod which is customarily supported at its ends from the side walls of the closet. Difficulty has been experienced in the past in maintaining the coat hangers in spaced relation with respect to each other so that a given garment can be removed from the closet without interferring with the garments on adjacent coat hangers.

A patentability search was conducted on the invention disclosed herein, and the following patents represent the prior art uncovered as a result of the search:

U.S. Pat. No. 3,482,746 issued to Ferguson on Dec. 9, 1969 shows spacers 22 slidable along a rod 24. Each spacer includes a groove 30 which will receive a coat hanger.

U.S. Pat. No. 3,902,597 issued to Brennan on Sept. 2, 1975 shows a hanger bar having spaced nibs 33 which can be used for separating garments supported on hangers.

German Pat. No. 1,252,386 (Mar. 3, 1965) shows a portable carrier bar for carrying a plurality of coat hangers thereon. More particularly, the German invention includes a central cylindrical portion 1 attached to a hanging hook 2 which is used for carrying the device as well as for hanging the device at a later time. A rod (not shown) extends through the cylindrical portion 1 on both sides thereof. Alternate chips or disks 6 and spacing rings 7 are received on the rod and extend outwardly from the center portion 1 to the ends of the device. End caps 4 having handle portions 5 are screwed to the ends of the rod (not shown) to hold the alternate disks and spacers on the rod.

U.S. Pat. Nos. 2,337,370 issued to Frisch et al on Mar. 6, 1956; 3,004,328 issued to Pepper et al on Oct. 17, 1961; 3,216,095 issued to Kurtz et al on Nov. 5, 1965; and 3,467,180 issued to Pensotti on Sept. 16, 1969 all relate to heat exchange elements, principally tubes having parallel fins.

SUMMARY OF THE INVENTION

The present invention involves a finned tube support for coat hangers. The finned tube support includes a hollow plastic tube attached to fit over a rod or pipe which is normally employed in a closet for supporting coat hangers thereon. The rod can be made of metal or wood. The rod is conventionally supplied in two standard diameters, one being about 1-1/16 inch and the other being about 1-7/16 inches. The length of the rod is dependent upon the width of the closet but will normally be between 2–6 feet in length. The ends of the rod are generally supported in grooves, notches, or holes in wood or metal pieces attached to the sides of the closet.

Thus, the hollow plastic tube will have an inner diameter slightly larger than the outer diameter of the rod upon which the tube is received. The wall thickness of the tube is preferably between 1/32 of an inch and 1/16 of an inch. Mounted on the plastic tube are a plurality of parallel circular disks or fins which are separated from each other by at least the thickness (or width) of a coat hanger. The maximum spacing will also be determined by the maximum width (or thickness) or conventional coat hangers. There are certain plastic coat hangers which are thicker (or wider) than the conventional wire coat hangers. Thus, the spacing between adjacent disks must be enough to accommodate any commercially available coat hanger.

One of the problems involved in supporting coat hangers on a rod is that the coat hangers tend to twist thereby interferring with articles on adjacent coat hangers. Therefore, the spacing between adjacent disks should be small enough or close enough to minimize the twisting problem. With both of the above considerations in mind, the spacing between adjacent disks should be between $\frac{3}{8}$ of an inch and $\frac{3}{4}$ of an inch, and preferably about 7/16 of an inch.

The disk should be made as thin as possible, but these disks must be sufficiently rigid to prevent undue bending thereof by the coat hangers; preferably, the thickness of the disk is about 1/16 of an inch. Assuming that there are a plurality of coat hangers disposed in certain of the spaces between the disks on the plastic tube, if one were to withdraw a garment by lifting one of the coat hangers away from the tube, it would be desirable to prevent contact between this garment and the end of a hook of any other hanger that might be supported on the finned tube support. Accordingly, the outer diameter of each disk is large enough that the disk extends beyond the tip of the coat hanger to prevent such contact.

When storing heavy and bulky garments, such as overcoats, it may be desirable to use only every third of fourth space to provide proper spacing between adjacent garments. The spacing between adjacent disks, however, still prevents undue twisting of the coat hanger while, at the sametime, providing sufficient space to accommodate any commercially available coat hanger.

DETAILED DESCRIPTION OF THE PREFERRED EMBODIMENTS

Figure 1:
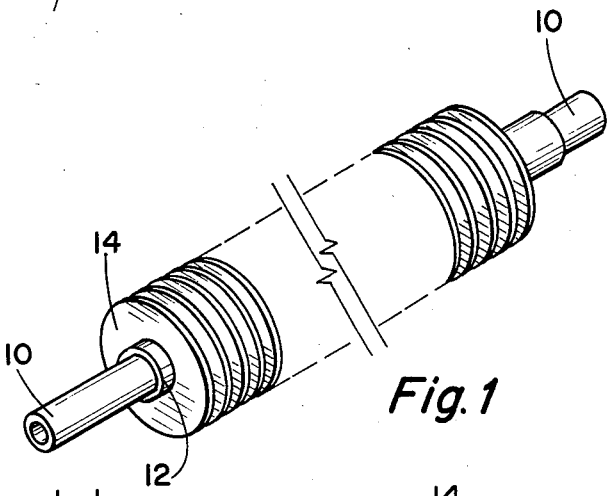
FIG. 1 is a perspective of the finned tube support of the present invention shown mounted on a rod.

Referring to the drawings in detail, FIG. 1 shows a rod 10 of the type normally employed in closets or the like for supporting coat hangers thereon. The rod 10 can be metal or wood. These rods are conventially supplied in two standard diameters one being about 1-1/16 inch and the other being about 1-7/16 inches; the length of these rods will vary, of course, depending upon the width of the closet, but will normally be between 2 feet to 6 feet in length. When the rod 10 is made of wood it is generally solid, but when the rod 10 is metal it is generally a standard hollow pipe. The ends of the rod are generally supported in grooves or notches or holes (not shown) in wood or metal pieces (not shown) attached to the sides of the closet.

The present invention involves a hollow plastic tube 12 having an inner diameter slightly larger than the outer diameter of the rod 10 which normally hangs in a closet (not shown) at about eye level and upon which the tube is received. The wall thickness of the tube 12 is preferably between 1/32 and 1/16 inch thick. The plastic tube 12 is provided with a plurality of parallel circular disks or fins 14 which are separated from each other by at least the thickness (or width) of a coat hanger. This spacing which will be described further in detail below is shown on FIG. 2 by the reference letter "d". It is recognized that there are numerous different types of coat hangers available in the market place; some of these hangers are made of plastic and are thicker than the conventional wire coat hanger. Thus, the spacing "d" between the adjacent disks 14 is at least equal to the width of any commercially available coat hanger.

Another one of the problems involved in supporting coat hangers on a rod, such as rod 10, is that the coat hangers tend to twist thereby interferring with articles on adjacent coat hangers. Thus, the spacing "d" between adjacent disks should be small enough or close enough to minimize the twisting problem. With both of the above considerations in mind, spacing between adjacent disks should be between ⅜ of an inch and ¾ of an inch and preferably about 7/16 of an inch.

The disks 14 should be made as thin as possible, but these fins must be sufficiently rigid to prevent undue bending thereof between coat hangers; preferably the thickness of the fin 14 is about 1/16 of an inch. As far as the outer diameter of the disk 14 is concerned, this will be dictated by the size of the conventional coat hanger and, more properly, by the tip of the hook of the coat hanger. As shown in phantom in FIG. 3, the tip 16 of the hook portion 18 of a conventional wire coat hanger (the remainder of which is not shown) would normally be situated as indicated in this figure. The outer periphery of the disk 14 would extend beyond the location of the tip 16 as indicated. In practice, the diameter of the disk 14, therefore, should be about 2½ inches. The inner diameter of the disk (the hole through which the tube 12 passes) is equal to the outer diameter of the tube 12. The disks 14 can be attached to the tube 12 by suitable plastic cement or adhesive; alternatively, the tube 12 and attached disks 14 can be molded as a single piece.

Figure 3:
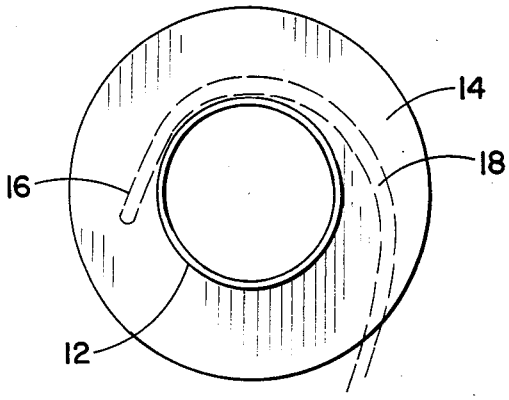
FIG. 3 is an end view of the support shown in FIG. 2 with the hook portion of a coat hanger being shown in phantom.
Figure 2:
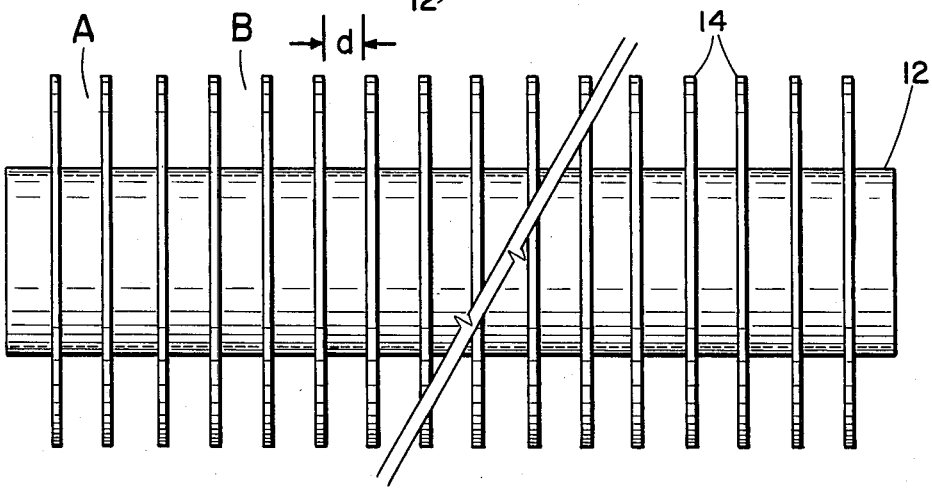
FIG. 2 is a side view of the finned tube support itself with the center portion broken out.

The configuration shown in FIGS. 2 and 3 represent a finned tube adapted to be inserted over a 1-1/16 inch o.d. wooden rod or metal pipe; if it were desired to provide a similar finned tube for a larger rod or pipe, the size of the tube 12 and the corresponding central opening in the disk 14 would be larger, but all other dimensions would remain the same, Utilizing the optimum dimensions indicated above, the center-to-center spacing (from the longitudinal center of one disk to the longitudinal center of an adjacent disk, or from the longitudinal center of one open space to the longitudinal center of the adjacent open space) is approximately ½ inch. When the ½ inch center-to-center spacing is used, this provides for the optimum number of light weight garments, such as shirts and blouses, to be hung along a given length of rod without severly compressing the garments together. This spacing may compress the garments slightly, but they are not packed together as would be the case without the use of the present invention. When every alternate garment space is used, creating an approximately one inch center-to-center spacing, items such as shirts and blouses will hang freely without compression.

As indicated above, the 2½ inch outer diameter of the fin or disk 14 will fully cover the tip of the hanger; in the case of closet rods being located one above the other in order to double the amount of hanging space, as is the case in may of today's closets, removal of an upper garment will not create the chance for the garment being removed to catch on the tip of a hook of a lower hung garment and tear the garment being removed or cause the removal of a lower hung garment if the hook tip of the lower garment were otherwise able to snag on a portion of the upper garment being removed. The same considerations hold true with respect to the removal of a garment from one of a pair of closet rods arranged in side by side relationship; also, this sizing of the outer diameter of the disk prevents or minimizes possible snagging by other hangers on the same rod when removing a garment.

If one were storing heavy and bulky articles such as overcoats, it might be desirable to space the hangers for these garments in every fourth space such as spaces "A" and "B" shown in FIG. 2; with this type of hanger spacing the interference between adjacent disks will still prevent undue twisting of the coat hanger while at the same time, accommodating the largest commercially available coat hanger.

The finned tube support of the present invention will be manufactured in standard lengths of two, three, four, five, or six foot lengths depending upon consumer demands. Obviously, a pair of two foot supports could be placed end to end on a four foot rod, etc. For odd lengths of rod it is possible to cut through the plastic tube of one of the finned tube supports and to utilize the cut portion by itself or in combination of another standard length of finned tube support.

Whereas the present invention has been described in particular relation to the drawings and sketches attached hereto, it should be understood that other and further modifications, apart from those shown or suggested herein, may be made within the spirit and scope of this invention.

What is claimed is:

1. A finned tube support for coat hangers comprising a hollow plastic tube of sufficient length and sufficient internal diameter to slip over a closet rod of the type normally employed for holding hangers thereon in a closet; said plastic tube having a wall thickness of about between 1/32 and 1/16 inch, a plurality of circular plastic disks mounted in spaced parallel relation on the tube and at right angles to the longitudinal central axis of the tube, said disks having an axial thickness of about 1/16 of an inch and a central opening equal to the outer diameter of the tube, said disk having an outer diameter such that the disk would extend beyond the location of the tip of a coat hanger which was supported on said tube; the spacing between adjacent disks being between ⅜ of an inch and ¾ of an inch.

2. A finned tube support for coat hangers as set forth in claim 2 wherein said outer diameter of said disk is equal to about 2 and ½ inches; the spacing between adjacent disks being such that the center-to-center spacing from one disk to the next adjacent disk is equal to about ½ inch.

* * * * *